US011404789B1

(12) United States Patent
Strojny

(10) Patent No.: US 11,404,789 B1
(45) Date of Patent: Aug. 2, 2022

(54) ALL-IN-ONE ANTENNA

(71) Applicant: The Government of the United States as represented by the Director, National Security Agency, Ft. George G. Meade, MD (US)

(72) Inventor: Brandan T. Strojny, Sykesville, MD (US)

(73) Assignee: U.S. Government as represented by the Director, National Security Agency, Washington, DC (US)

( * ) Notice: Subject to any disclaimer, the term of this patent is extended or adjusted under 35 U.S.C. 154(b) by 0 days.

(21) Appl. No.: 17/188,074

(22) Filed: Mar. 1, 2021

(51) Int. Cl.

| | |
|---|---|
| ***H01Q 9/28*** | (2006.01) |
| ***H01Q 21/20*** | (2006.01) |
| ***H01Q 13/04*** | (2006.01) |
| ***H01Q 9/06*** | (2006.01) |

(52) U.S. Cl.
CPC ..... *H01Q 9/28* (2013.01); *H01Q 9/065* (2013.01); *H01Q 13/04* (2013.01); *H01Q 21/205* (2013.01)

(58) Field of Classification Search
CPC ..... H01Q 9/28; H01Q 9/065; H01Q 13/04; H01Q 21/205
See application file for complete search history.

(56) References Cited

FOREIGN PATENT DOCUMENTS

| | | | | |
|---|---|---|---|---|
| WO | WO-2011113542 A1 * | 9/2011 | ..... | H01Q 13/12 |
| WO | WO-2019016593 A1 * | 1/2019 | ..... | H01Q 1/1257 |

* cited by examiner

*Primary Examiner* — Hoang V Nguyen

(57) ABSTRACT

An antenna is disclosed, including an omnidirectional antenna with a first conical antenna section. The omnidirectional antenna forms a first feed aperture. The omnidirectional antenna forms a field of view aperture in a wall of the omnidirectional antenna. The antenna also includes a directional antenna, disposed within an interior portion of the omnidirectional antenna such that the directional antenna has an electrically unobstructed field of view through the field of view aperture in the wall of the omnidirectional antenna. The antenna also includes a feed cable, electrically coupled to the directional antenna and disposed within the omnidirectional antenna and the first feed aperture.

5 Claims, 8 Drawing Sheets

ALL-IN-ONE ANTENNA

FIELD OF INVENTION

The present invention relates, in general, to antennas, and in particular, to systems and devices for multiple co-located antennas.

BACKGROUND OF THE INVENTION

Antennas may be used to transmit and receive signals of many different types, including signals sent over dramatically different wavelengths and spectra. It may be preferred to mount multiple antennas of different types in a single location. Prior art approaches have faced difficulties relating to electrical interference mitigation between multiple antennas in close proximity to one another. For example, it may be difficult to properly position feed cables for multiple antennas such that they do not cause shorts and do not physically impede other elements. Additionally, antennas in close electrical proximity can interfere with one another, degrading the radiation pattern and impedance match, directly degrading signal quality. As a result, such systems may take up large amounts of space.

SUMMARY

An embodiment of the present invention is an antenna, including an omnidirectional antenna having a first conical antenna section. The omnidirectional antenna forms a first feed aperture. The omnidirectional antenna also forms a field of view aperture in a wall of the omnidirectional antenna. The antenna also includes a directional antenna, disposed within an interior portion of the omnidirectional antenna such that the directional antenna has an electrically unobstructed field of view through the field of view aperture in the wall of the omnidirectional antenna. The antenna also includes a feed cable, electrically coupled to the directional antenna and disposed within the omnidirectional antenna and the first feed aperture.

In a related embodiment, the omnidirectional antenna includes a conical antenna. The conical antenna includes the first conical antenna section and a second conical antenna section. The conical antenna forms the first feed aperture in the first conical antenna section and a second feed aperture in the second conical antenna section.

In a further related embodiment, the omnidirectional antenna also includes a cylindrical dipole antenna having a first cylindrical antenna section and a second cylindrical antenna section. The first cylindrical antenna section is electrically coupled to the first conical antenna section of the conical antenna. The second cylindrical antenna section is electrically coupled to the second conical antenna section of the conical antenna. The first cylindrical antenna section forms a field of view aperture in a cylindrical wall of the first cylindrical antenna section. The feed cable is further disposed within the first cylindrical antenna section of the cylindrical dipole antenna, the first feed aperture, the second feed aperture, and the second cylindrical antenna section of the cylindrical dipole antenna.

DETAILED DESCRIPTION

Figure 1:
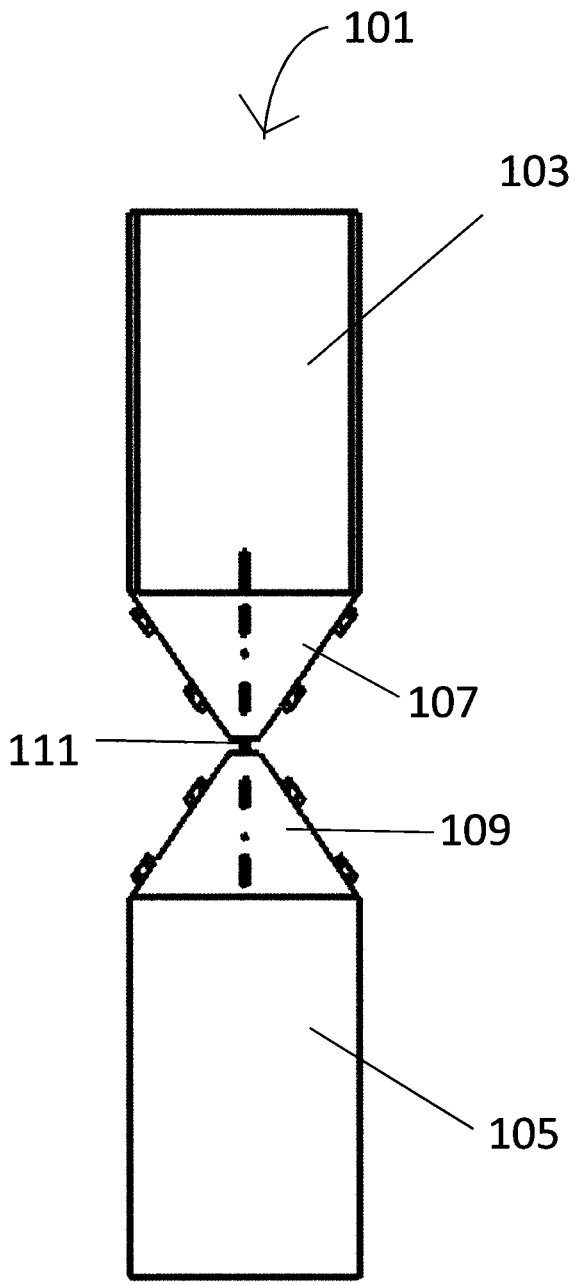
FIG. 1 is a diagram illustrating a biconical antenna system.
Figure 2A:
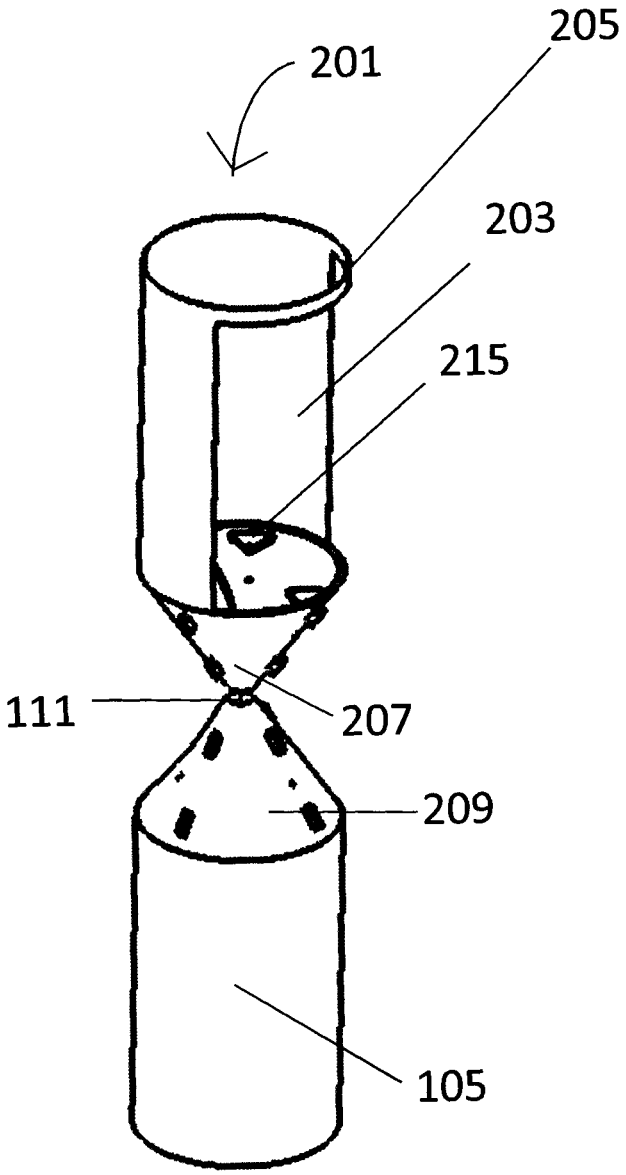
FIGS. 2A-2D are diagrams illustrating a dipole antenna system in accordance with an embodiment of the present invention.
Figure 2B:
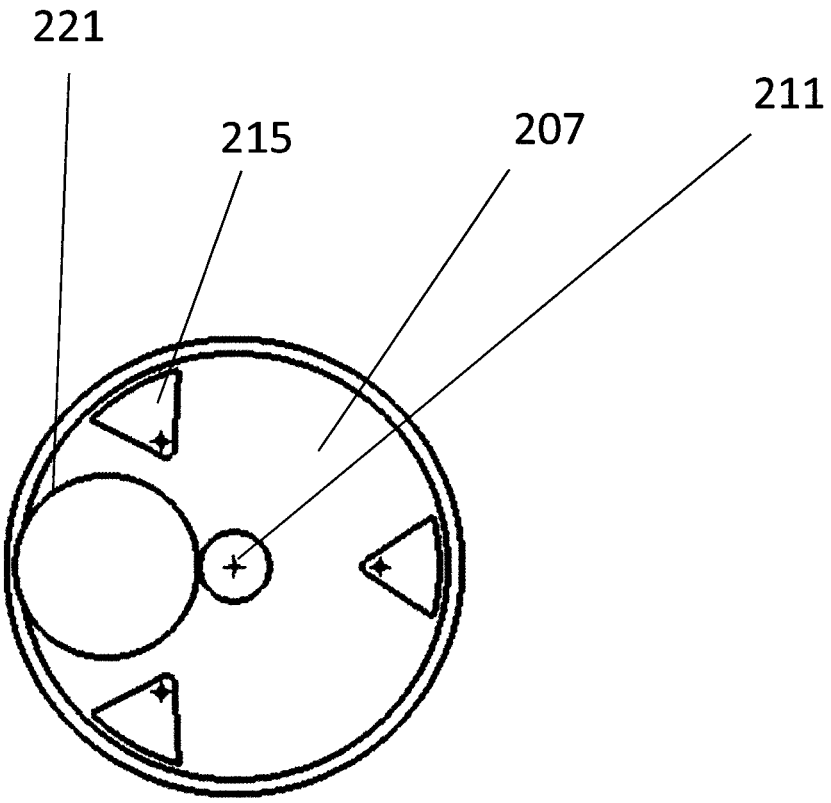
Figure 2C:
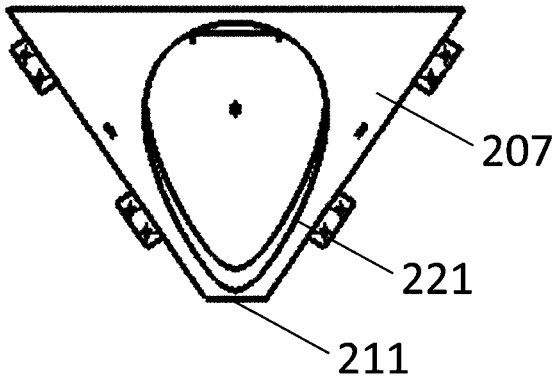
Figure 2D:
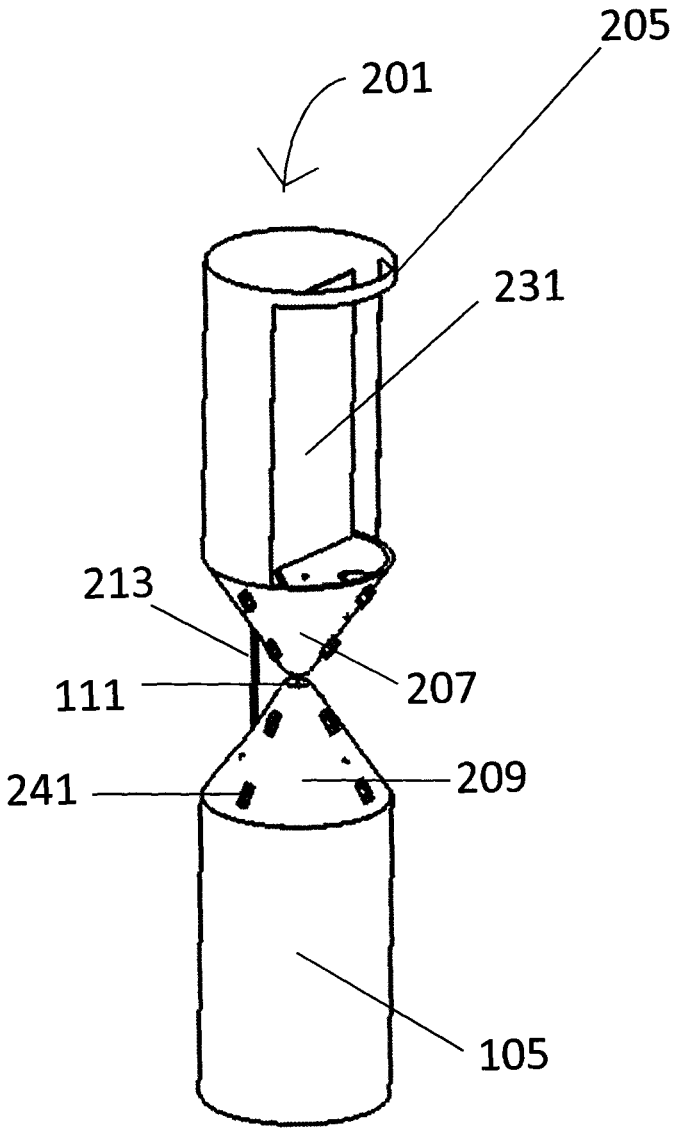

An antenna system 101 is described presently with reference to FIG. 1. The antenna system 101 comprises a cylindrical dipole antenna and a biconical dipole antenna. These components combine to operate as an omnidirectional receiver. The cylindrical dipole antenna comprises a first cylindrical half 103 and a second cylindrical half 105. The biconical dipole antenna comprises a first conical half 107 and a second conical half 109. The first conical half 107 and the second conical half 109 meet at a vertex 111. Each of the first cylindrical half 103, the second cylindrical half 105, the first conical half 107, the second conical half 109, and the vertex 111 comprise an electrically-conductive material. The first cylindrical half 103 is electrically coupled to the first conical half 107. The first conical half 107 is electrically coupled to the second conical half 109 via the vertex 111. The second conical half 109 is electrically coupled to the second cylindrical half 105.

An antenna system 201 in accordance with an embodiment of the present invention is now described with reference to FIGS. 2A-2D. Unlike antenna system 101, antenna system 201 does not have a complete first cylindrical half. Instead, antenna system 201 comprises a partial cylindrical half. The partial cylindrical half has a partial cylindrical wall 203 which forms a partial cylinder, but which is open on one side. The partial cylindrical half also preferably comprises a circular conductive ring 205. The inventor has appreciated that the electromagnetic properties of a conventional cylindrical antenna may be approximated by a partial cylinder without unacceptable loss of fidelity, and that maintaining at least a small portion of the partial cylindrical half that forms a complete circle is beneficial for the fidelity of this antenna shape. The partial cylindrical half sweeps through less than the full 360 degree arc of a complete cylinder, and in the illustrated embodiment sweeps an arc of approximately 180 degrees. The electromagnetic characteristics for this portion of the antenna system depend on the sweep of this arc, and those of ordinary skill in the art will appreciate the design considerations that choice of this arc entail. For structural stability, the partial cylindrical half also may form a complete cylinder, but wherein the complete cylinder comprises a partial cylindrical wall 203 made from an electrically conductive material as just described, and wherein the remainder of the cylinder is made from an electrically inert material that is transparent to electromagnetic radiation. In other embodiments, a cylindrical wall may comprise a frequency selective surface, configured such that the cylindrical wall is conductive and comprises an arm of the omnidirectional antenna, while simultaneously allowing selected frequencies of electromagnetic radiation to pass through the frequency selective surface substantially unhindered, thereby allowing one or more directional antenna(s) in the interior to function effectively.

Antenna system 201 also comprises a first partial conical half 207 and a second partial conical half 209. Each of the first partial conical half 207 and the second partial conical half 209 forms a feed aperture 221 (see FIGS. 2B and 2C) to allow a feed cable 213 (see FIG. 2D) to pass through a bottom end of the second cylindrical half 105, through the feed aperture in the second partial conical half 209, and through the feed aperture in the first conical half 207. The feed cable may be connected to a directional antenna 231 (see FIG. 2D) situated in front of the partial cylindrical wall 203. The interior assembly for the directional antenna 231 may be mounted to the conical half 207 at mounting points 215. This configuration allows the antenna feed to reach the directional antenna while avoiding a potential electrical short from coming into contact with the walls of the cones and cylinders of the antenna system. The field of view in front of the directional antenna 231 is electrically unobstructed due to the fact that the partial cylindrical wall 203 is open at that point. This allows for simultaneous reception by both the omnidirectional antenna (including the partial cylindrical wall 203 and the directional antenna 231. For structural stability, one or more support rods may run between the surfaces of the first conical half 207 and the second conical half 209. In other embodiments, one or more supporting walls of stiff non-conductive material may be employed to provide structural stability. These walls may be mounted using attachment points 241 on the outer surfaces of the first partial conical half 207 and the second partial conical half 209. The support rods and/or supporting walls may be made using an electrically inert material so that they do not electrically interfere with operation of the antenna components of the present system.

An illustrative embodiment of the present invention has been described above, but additional embodiments are also contemplated within the scope of the present disclosure. For example, while an antenna system 201 was shown in FIG. 2D having a single directional antenna 231 situated within the arc of a partial cylindrical wall 203, in alternate embodiments multiple directional antennas may be present, so that the single compact antenna system may receive and process multiple directional signals simultaneously with distinct antenna hardware. Utilizing multiband individual antennas creates a multiband antenna system with increased performance at discrete frequency bands of interest. Additionally, alternative antenna configurations are contemplated. For example, a cylindrical monopole having only a single partial cylindrical section may be employed. In another example, the antenna system may comprise no cylindrical or partial cylindrical sections, and may instead comprise a partial conical wall and one or more directional antennas situated within the orbit of the partial conical wall.

Figure 3A:
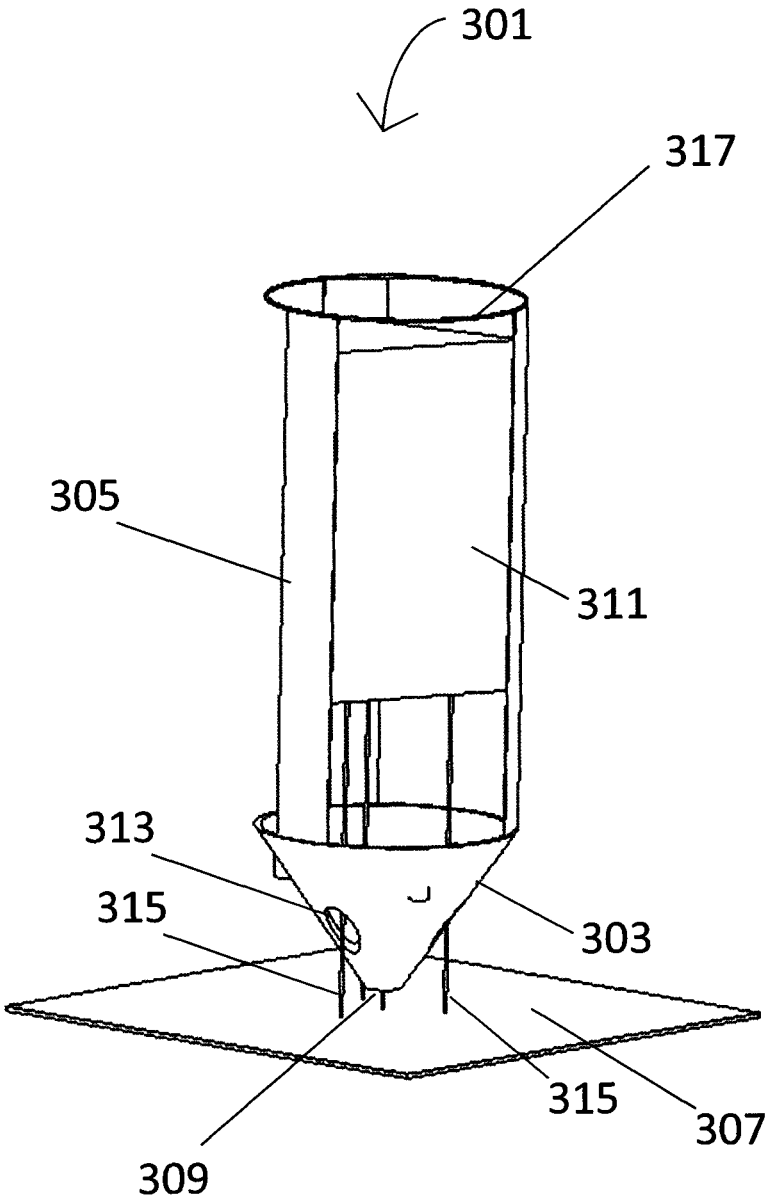
FIGS. 3A-3B are diagrams illustrating monopole antenna systems in accordance with embodiments of the present invention.

Another embodiment of the present invention is shown in FIG. 3A. The illustrated configuration comprises a conical monopole antenna system 301. This configuration includes a single conical element 303, which is electrically connected to a conductive partial cylindrical wall 305. The conical element 303 is also coupled to a ground plate 307 at a vertex 309. The ground plate 307 is formed from a conductive substance and preferably allows for the entire antenna system 301 to rest securely on a flat surface with the ground plate 307 at the bottom. The ground plate 307 may have various shapes; it may be a square, a rectangle, or a circle, for example. The ground plate 307 also may have a diameter of at least twice the diameter of the cylindrical wall 305 and the widest diameter of the conical element 303. The presently described embodiment also includes multiple directional antennas 311 disposed within the partial cylindrical wall 305. As with previously described embodiments, the openings in the partial cylindrical wall 305 allows for an electrically unobstructed field of view to the directional antennas 311 disposed therein. According to the presently described embodiment, the conical element 303 has multiple feed apertures 313. Each of the three directional antennas 311 is fed by a feed cable 315 that enters through one of the feed apertures 313 while remaining electrically isolated from the conical element 303 and partial cylindrical wall 305. The separate portions of the partial cylindrical wall 305 are also connected by a conductive ring 317 that both provides structural stability and defines the electromagnetic characteristics of the conical monopole antenna system 301.

Figure 3B:
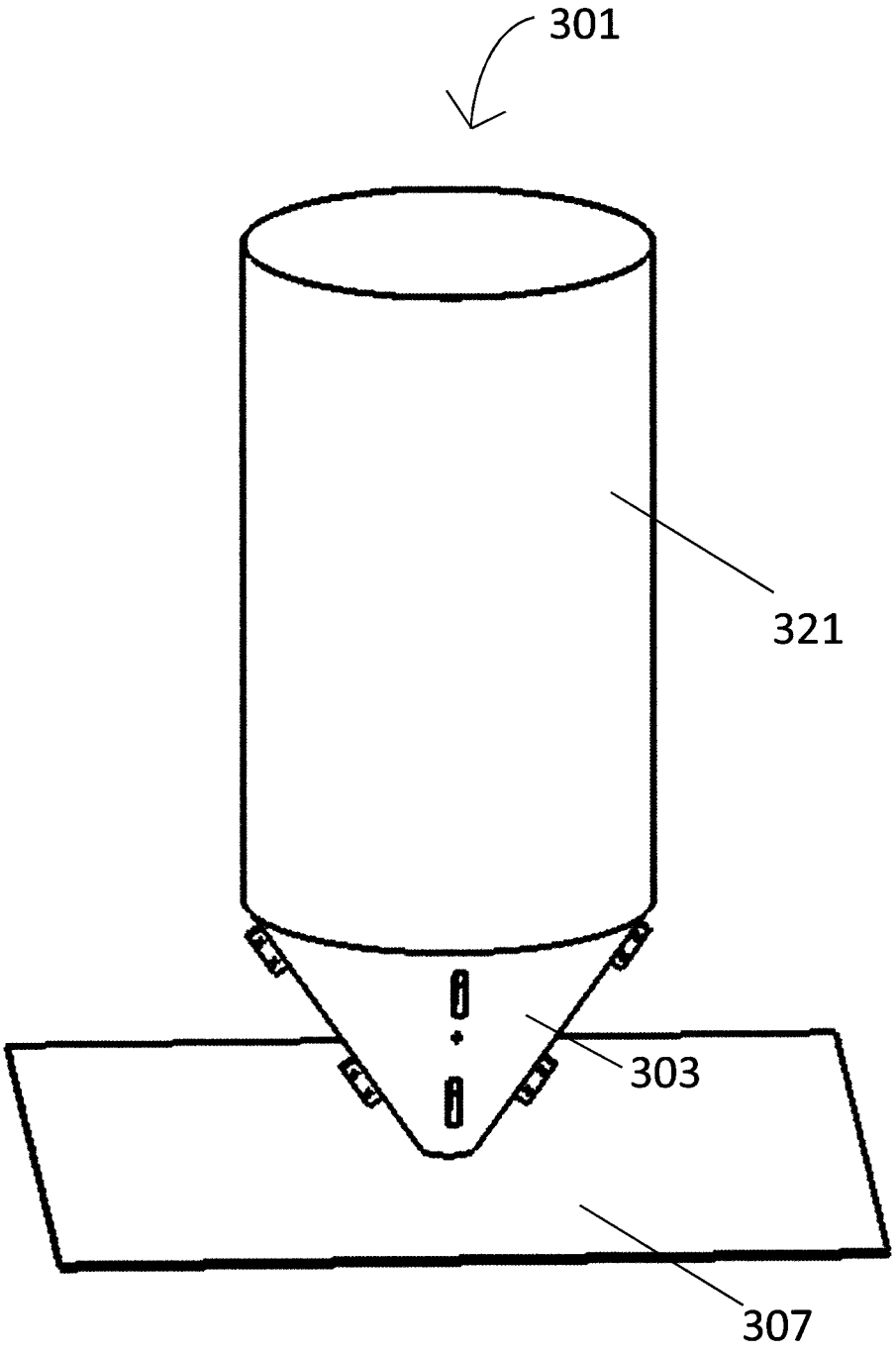

A related embodiment is illustrated in FIG. 3B. Here also, a conical monopole antenna system 301 includes a single conical element 303 coupled to a ground plate 307. The conical element is also electrically connected to a cylindrical wall 321. The cylindrical wall 321 may be electrically conductive in part, but non-conductive in other parts, so as to allow one or more directional antennas (not shown) to operate from within the interior of the cylindrical wall 321.

Figure 4:
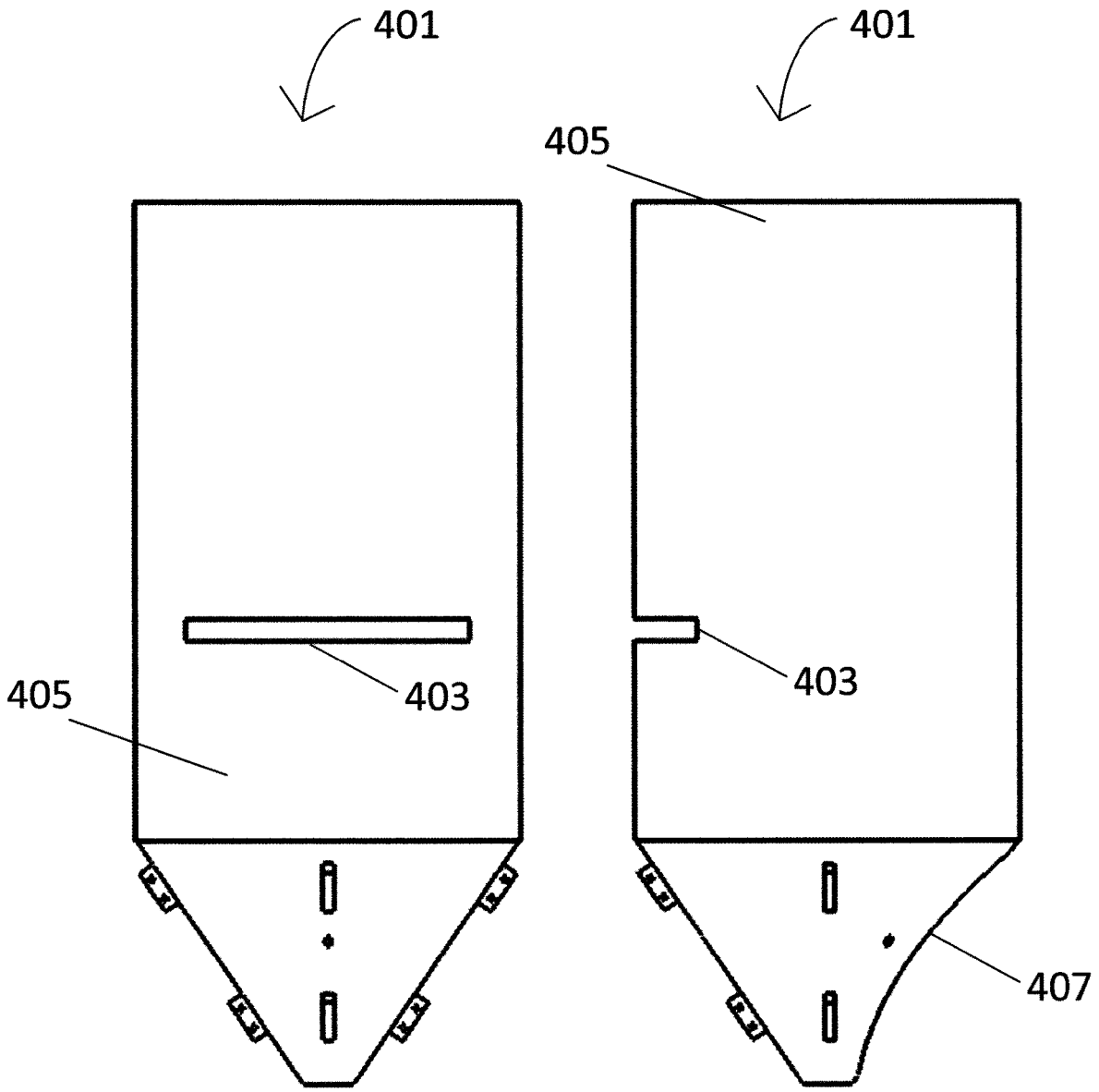
FIG. 4 is a diagram illustrating a slot aperture coupled antenna system in accordance with an embodiment of the present invention.

Another embodiment is illustrated in FIG. 4. Instead of situating a directional antenna in an interior space within a cylindrical or partially-cylindrical section of a conical dipole or monopole antenna, one or more directional antennas may be integrated into the structure 401 as an aperture coupled slot 403. The slot 403 may be formed as an aperture within the structure of the conductive material of the cylindrical wall 405 and may be situated in any orientation. When the slot is perpendicular to the length of the cylindrical wall 405 it will transmit and receive vertically polarized signals. Additional slots can be integrated throughout the structure to form different polarized signals, and slots can be crossed to create circular polarization A plate can be placed internally to increase the slot directivity. The slot 403 can receive an antenna feed (not shown) through a feed aperture 407, which allows the slot 403 antenna to be fed without interfering electrically with the conical antenna.

While the above description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments described herein can be embodied within a form that may not provide all of the features and benefits set forth herein, as some features can be used or practiced separately from others. The scope of the invention is indicated by the appended claims rather than the foregoing description. All changes which come within the meaning and range of equivalency of the claims are to be embraced within their scope.

I claim:

1. An antenna, comprising:

an omnidirectional antenna comprising a first conical antenna section, wherein the omnidirectional antenna forms a first feed aperture and wherein the omnidirectional antenna forms a field of view aperture in a wall of the omnidirectional antenna; and a directional antenna, disposed within an interior portion of the omnidirectional antenna such that the directional antenna has an electrically unobstructed field of view through the field of view aperture in the wall of the omnidirectional antenna; and a feed cable, electrically coupled to the directional antenna and disposed within the omnidirectional antenna and the first feed aperture.

2. An antenna in accordance with claim 1, wherein:

the omnidirectional antenna comprises a conical antenna, the conical antenna comprising the first conical antenna section and a second conical antenna section, wherein the conical antenna forms the first feed aperture in the first conical antenna section and a second feed aperture in the second conical antenna section.

3. An antenna in accordance with claim 2, wherein:

the omnidirectional antenna further comprises a cylindrical dipole antenna having a first cylindrical antenna section and a second cylindrical antenna section, wherein:

the first cylindrical antenna section is electrically coupled to the first conical antenna section of the conical antenna;

the second cylindrical antenna section is electrically coupled to the second conical antenna section of the conical antenna; and the first cylindrical antenna section forms a field of view aperture in a cylindrical wall of the first cylindrical antenna section; and wherein the feed cable is further disposed within the first cylindrical antenna section of the cylindrical dipole antenna, the first feed aperture, the second feed aperture, and the second cylindrical antenna section of the cylindrical dipole antenna.

4. An antenna in accordance with claim 1, wherein the omnidirectional antenna further comprises a conductive flat plate, coupled to and disposed perpendicularly to the first conical section.

5. An antenna, comprising:

an omnidirectional antenna comprising a first conical antenna section, wherein the omnidirectional antenna forms a first feed aperture and wherein the omnidirectional antenna comprises a frequency selective surface;

a directional antenna disposed within an interior portion of the omnidirectional antenna such that the directional antenna has an electrically unobstructed field of view through the frequency selective surface of the omnidirectional antenna; and a feed cable, electrically coupled to the directional antenna and disposed within the omnidirectional antenna and the first feed aperture.

* * * * *